US012215915B2

(12) United States Patent
Shibuya et al.

(10) Patent No.: US 12,215,915 B2
(45) Date of Patent: Feb. 4, 2025

(54) REFRIGERATION APPARATUS FOR TRANSPORT AND TRANSPORT CONTAINER

(71) Applicant: DAIKIN INDUSTRIES, LTD., Osaka (JP)

(72) Inventors: Kento Shibuya, Osaka (JP); Wataru Hirata, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 125 days.

(21) Appl. No.: 17/874,914

(22) Filed: Jul. 27, 2022

(65) Prior Publication Data

US 2022/0357094 A1 Nov. 10, 2022

Related U.S. Application Data

(63) Continuation of application No. PCT/JP2021/004017, filed on Feb. 4, 2021.

(30) Foreign Application Priority Data

Mar. 6, 2020 (JP) ..... 2020-038692

(51) Int. Cl.
*F25D 17/08* (2006.01)
*F25D 11/00* (2006.01)

(52) U.S. Cl.
CPC ..... *F25D 17/08* (2013.01); *F25D 11/003* (2013.01)

(58) Field of Classification Search
CPC ..... F25D 17/08; F25D 11/003; F25D 23/003; F25D 29/005; F25D 2317/067; F25B 41/20; F25B 41/24; F25B 47/022; F25B 2400/13
See application file for complete search history.

(56) References Cited

U.S. PATENT DOCUMENTS

| | | | |
|---|---|---|---|
| 4,748,824 | A | 6/1988 | Wakabayashi et al. |
| 2012/0079843 | A1 | 4/2012 | Ikemiya et al. |
| 2014/0290297 | A1 | 10/2014 | Yoshimura et al. |
| 2020/0386420 | A1 | 12/2020 | Fujita et al. |

FOREIGN PATENT DOCUMENTS

| | | | | |
|---|---|---|---|---|
| EP | 0220625 B1 * | 10/1986 | | |
| EP | 0220625 A2 * | 1/1992 | ..... | F25D 19/003 |
| EP | 2 675 054 A1 | 12/2013 | | |

(Continued)

OTHER PUBLICATIONS

Extended European Search Report for European Application No. 21764905.2, dated Jun. 12, 2023.

(Continued)

*Primary Examiner* — Emmanuel E Duke
(74) *Attorney, Agent, or Firm* — BIRCH, STEWART, KOLASCH & BIRCH, LLP

(57) ABSTRACT

A refrigeration apparatus for transport includes an electric component box that houses an inverter board and is arranged on a lateral side of an external heat exchanger. The electric component box has an opposing plate that faces an air entrance surface of the external heat exchanger. A heat sink is provided on the opposing plate of the electric component box. The heat sink is exposed to the outside of the electric component box to cool a power module on the inverter board.

19 Claims, 8 Drawing Sheets

(56) References Cited

FOREIGN PATENT DOCUMENTS

| | | | | | |
|---|---|---|---|---|---|
| EP | 3 382 316 | A1 | | 10/2018 | |
| EP | 3 415 844 | A1 | | 12/2018 | |
| JP | 62-91773 | A | | 4/1987 | |
| JP | 5-79661 | A | | 3/1993 | |
| JP | 2003-97881 | A | | 4/2003 | |
| JP | 2007-267478 | A | | 10/2007 | |
| JP | 2011112267 | A | * | 6/2011 | |
| JP | 2011-208909 | A | | 10/2011 | |
| JP | 2012-164878 | A | | 8/2012 | |
| JP | 2014-48816 | A | | 3/2014 | |
| JP | 2015-127630 | A | | 7/2015 | |
| JP | 2019-163915 | A | | 9/2019 | |
| WO | WO-2010143407 | A1 | * | 12/2010 | ..... B60P 3/20 |
| WO | WO-2015045252 | A1 | * | 4/2015 | ..... F25B 31/006 |
| WO | WO 2017/150219 | A1 | | 9/2017 | |
| WO | WO 2018/225846 | A1 | | 12/2018 | |
| WO | WO 2019/244405 | A1 | | 12/2019 | |

OTHER PUBLICATIONS

International Preliminary Report on Patentability and Written Opinion of the International Searching Authority for International Application No. PCT/JP2021/004017, dated Sep. 15, 2022.
International Search Report for PCT/JP2021/004017 (PCT/ISA/210) mailed on Mar. 30, 2021.
Written Opinion of the International Searching Authority for PCT/JP2021/004017 (PCT/ISA/237) mailed on Mar. 30, 2021.

* cited by examiner

REFRIGERATION APPARATUS FOR TRANSPORT AND TRANSPORT CONTAINER

CROSS REFERENCE TO RELATED APPLICATIONS

This application is a Continuation of PCT International Application No. PCT/JP2021/004017, filed on Feb. 4, 2021, which claims priority under 35 U.S.C. 119(a) to Patent Application No. 2020-038692, filed in Japan on Mar. 6, 2020, all of which are hereby expressly incorporated by reference into the present application.

TECHNICAL FIELD

The present disclosure relates to a refrigeration apparatus for transport and a transport container.

BACKGROUND ART

Patent Document 1 discloses a container refrigeration apparatus. In this container refrigeration apparatus, an inverter box housing a substrate is provided below a condenser formed in a flat plate shape. Radiation fins are provided on a rear surface of the inverter box. The radiation fins in this container refrigeration apparatus dissipate heat to the air flowing between the rear surface of the inverter box and a casing.

CITATION LIST

Patent Document

Patent Document 1: Japanese Unexamined Patent Publication No. 2015-127630

SUMMARY

A first aspect of the present disclosure is directed to a refrigeration apparatus for transport (10), including: a condenser (32); and a box (36) arranged on a lateral side of the condenser (32) and houses an inverter board (70), wherein the box (36) has an opposing plate (36*e*) that faces an air entrance surface (32*a*) of the condenser (32), and the refrigeration apparatus for transport further includes a heat sink (75) that is provided on the opposing plate (36*e*) and exposed to an outside of the box (36) to cool a heat-producing component (71) on the inverter board (70).

DESCRIPTION OF EMBODIMENTS

An embodiment of the present disclosure will be described below with reference to the drawings. The following embodiment is merely an exemplary one in nature, and is not intended to limit the scope, applications, or use of the present invention.

Embodiment

Figure 1:
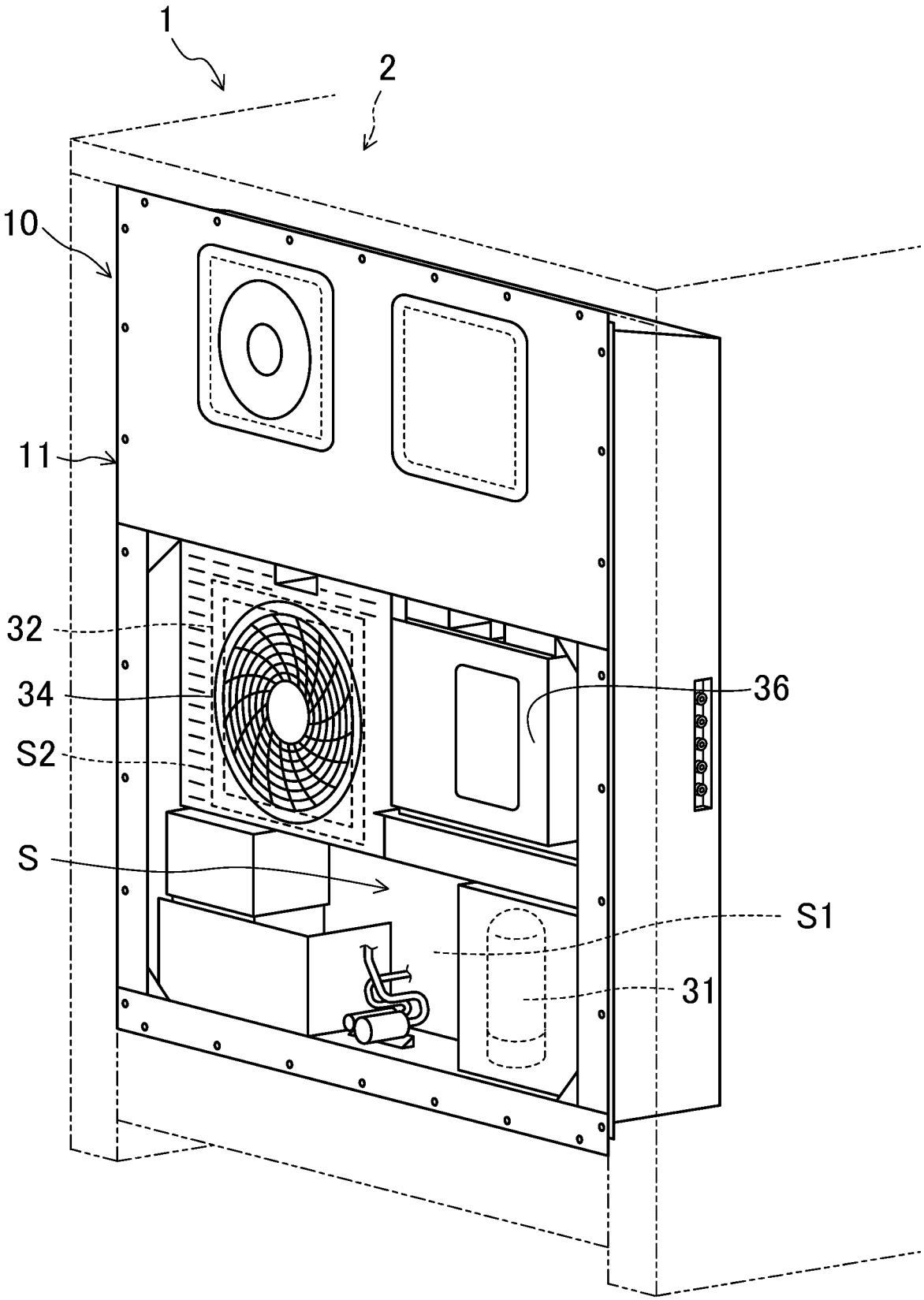
FIG. 1 is a perspective view illustrating a transport container according to an embodiment as viewed from the front.

The present disclosure relates to a transport container (1). As illustrated in FIG. 1, the transport container (1) includes a container body (2) and a refrigeration apparatus for transport (10) provided in the container body (2). The transport container (1) is used for marine transportation. The transport container (1) is conveyed by a marine transporter, such as a ship. Unless otherwise specified, the terms in the following description which indicate directions, such as "upper," "top," "lower," "bottom," "right," "left," "front," and "rear," refer to the directions when the refrigeration apparatus for transport (10) is viewed from the front.

—Container Body—

The container body (2) is formed in a hollow box-like shape. The container body (2) is formed to be horizontally long. The container body (2) has an opening formed at one end in the longitudinal direction. The refrigeration apparatus for transport (10) blocks the opening of the container body (2). The container body (2) forms therein a storage space (5) for storing articles to be transported. Articles to be transported are stored in the storage space (5). The refrigeration apparatus for transport (10) adjusts the temperature of the air in the storage space (5) (may also be referred to as inside air).

—Refrigeration Apparatus for Transport—

The refrigeration apparatus for transport (10) is attached to the opening of the container body (2). The refrigeration apparatus for transport (10) includes a casing (11) and a refrigerant circuit (C).

<Casing>

Figure 2:
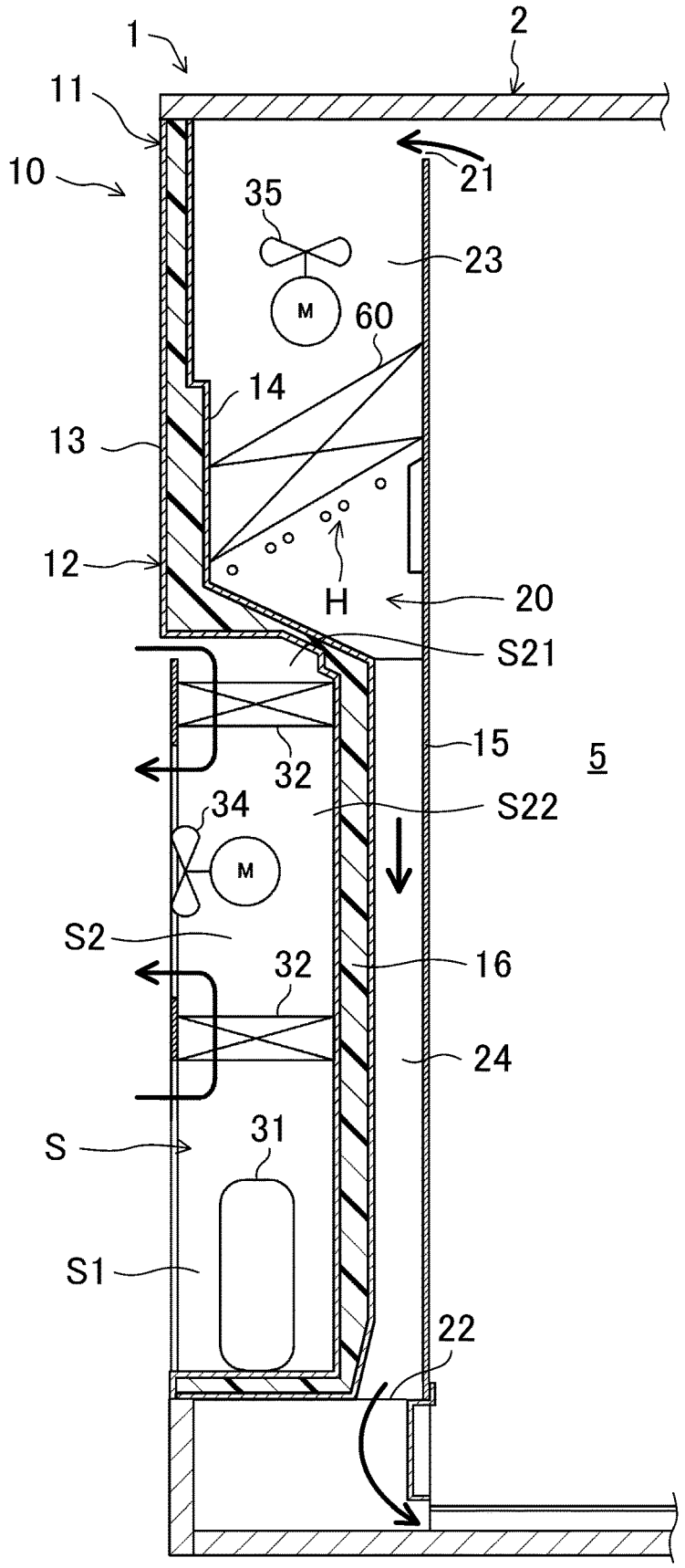
FIG. 2 is a longitudinal cross-sectional view schematically illustrating an internal structure of the transport container according to the embodiment.

As schematically illustrated in FIG. 2, the casing (11) includes a division wall (12) and a partition plate (15).

An internal flow path (20) is formed inside the division wall (12). An external chamber (S) is formed outside the division wall (12). The external chamber (S) corresponds to a space for housing components. The division wall (12) separates the internal flow path (20) from the external chamber (S).

The division wall (12) includes an exterior wall (13) and an interior wall (14). The exterior wall (13) is located outside the container body (2). The interior wall (14) is located inside the container body (2). The exterior wall (13) and the interior wall (14) are made of, for example, an aluminum alloy.

The exterior wall (13) closes the opening of the container body (2). The exterior wall (13) is attached to a peripheral portion of the opening of the container body (2). A lower portion of the exterior wall (13) bulges toward the inside of the container body (2). The external chamber (S) is formed inside the bulging exterior wall (13).

The interior wall (14) faces the exterior wall (13). The interior wall (14) has a shape conforming to the exterior wall (13). The interior wall (14) is spaced apart from the exterior wall (13). A thermal insulator (16) is provided between the interior wall (14) and the exterior wall (13).

The partition plate (15) is arranged further inward of the container body (2) than the interior wall (14). The internal flow path (20) is formed between the division wall (12) and the partition plate (15). An inflow port (21) is formed between an upper end of the partition plate (15) and a top panel of the container body (2). An outflow port (22) is formed between a lower end of the partition plate (15) and a lower end of the division wall (12). The internal flow path (20) extends from the inflow port (21) to the outflow port (22).

The internal flow path (20) includes an upper flow path (23) and a lower flow path (24). The upper flow path (23) is an upper portion of the internal flow path (20). The lower flow path (24) is a lower portion of the internal flow path (20). The lower flow path (24) is located at a position corresponding to the bulging portion of the division wall (12).

<Components of Refrigerant Circuit>

The refrigerant circuit (C) is filled with a refrigerant. The refrigerant circulates in the refrigerant circuit (C) to perform a vapor compression refrigeration cycle. The refrigerant circuit (C) includes a compressor (31), an external heat exchanger (32), an expansion valve (33), an internal heat exchanger (60), and a refrigerant pipe connecting these components.

The compressor (31) is arranged closer to the right side in a first space (S1) corresponding to a lower portion of the external chamber (S). The compressor (31) sucks and compresses a low-pressure refrigerant. The compressor (31) discharges the compressed refrigerant as a high-pressure refrigerant.

The external heat exchanger (32) is arranged closer to the left side in a second space (S2) corresponding to an upper portion of the external chamber (S). The external heat exchanger (32) is a fin-and-tube heat exchanger. The external heat exchanger (32) is a so-called four-side heat exchanger. The external heat exchanger (32) has a generally rectangular tubular shape. The external heat exchanger (32) functions as a condenser or a radiator.

The internal heat exchanger (60) is arranged in the internal flow path (20). The internal heat exchanger (60) is supported between the division wall (12) and the partition plate (15). The internal heat exchanger (60) is a fin-and-tube heat exchanger. The internal heat exchanger (60) functions as an evaporator.

<External Fan>

The refrigeration apparatus for transport (10) includes a single external fan (34). The external fan (34) is arranged in the second space (S2) of the external chamber (S). The external fan (34) is arranged inside the four heat exchange sections of the external heat exchanger (32). The external fan (34) is a propeller fan.

When the external fan (34) operates, the outside air flows from the outside to the inside of the external heat exchanger (32). The air inside the external heat exchanger (32) is blown out of the casing (11).

<Internal Fan>

The refrigeration apparatus for transport (10) includes two internal fans (35). The internal fans (35) are arranged in the upper flow path (23) of the internal flow path (20). The internal fans (35) are arranged above the internal heat exchanger (60). The internal fans (35) are arranged upstream of the internal heat exchanger (60) in the direction of air flow. The internal fans (35) are propeller fans. The internal fans (35) may be reduced to one, or may be increased to three or more.

When the internal fans (35) operate, the air in the storage space (5) flows into the upper flow path (23) of the internal flow path (20) through the inflow port (21). The air in the upper flow path (23) of the internal flow path (20) passes through the internal heat exchanger (60) and a heater (H) described later, and flows through the lower flow path (24). The air in the lower flow path (24) flows into the storage space (5) through the outflow port (22).

<Heater>

The refrigeration apparatus for transport (10) includes a heater (H). The heater (H) is arranged below the internal heat exchanger (60). The heater (H) is attached to a lower portion of the internal heat exchanger (60). When the heater (H) operates, the internal heat exchanger (60) is heated. The heat of the heater (H) melts frost attached to the internal heat exchanger (60). The heater (H) is used to defrost the internal heat exchanger (60).

<Electric Component Box>

As illustrated in FIG. 1, the refrigeration apparatus for transport (10) includes an electric component box (36). The electric component box (36) is arranged in the second space (S2) of the external chamber (S). As will be described in detail later, the electric component box (36) houses electric components, such as an inverter board (70), a control board (72), a relay board (73), and reactors (74).

—Details of Refrigerant Circuit—

Figure 3:
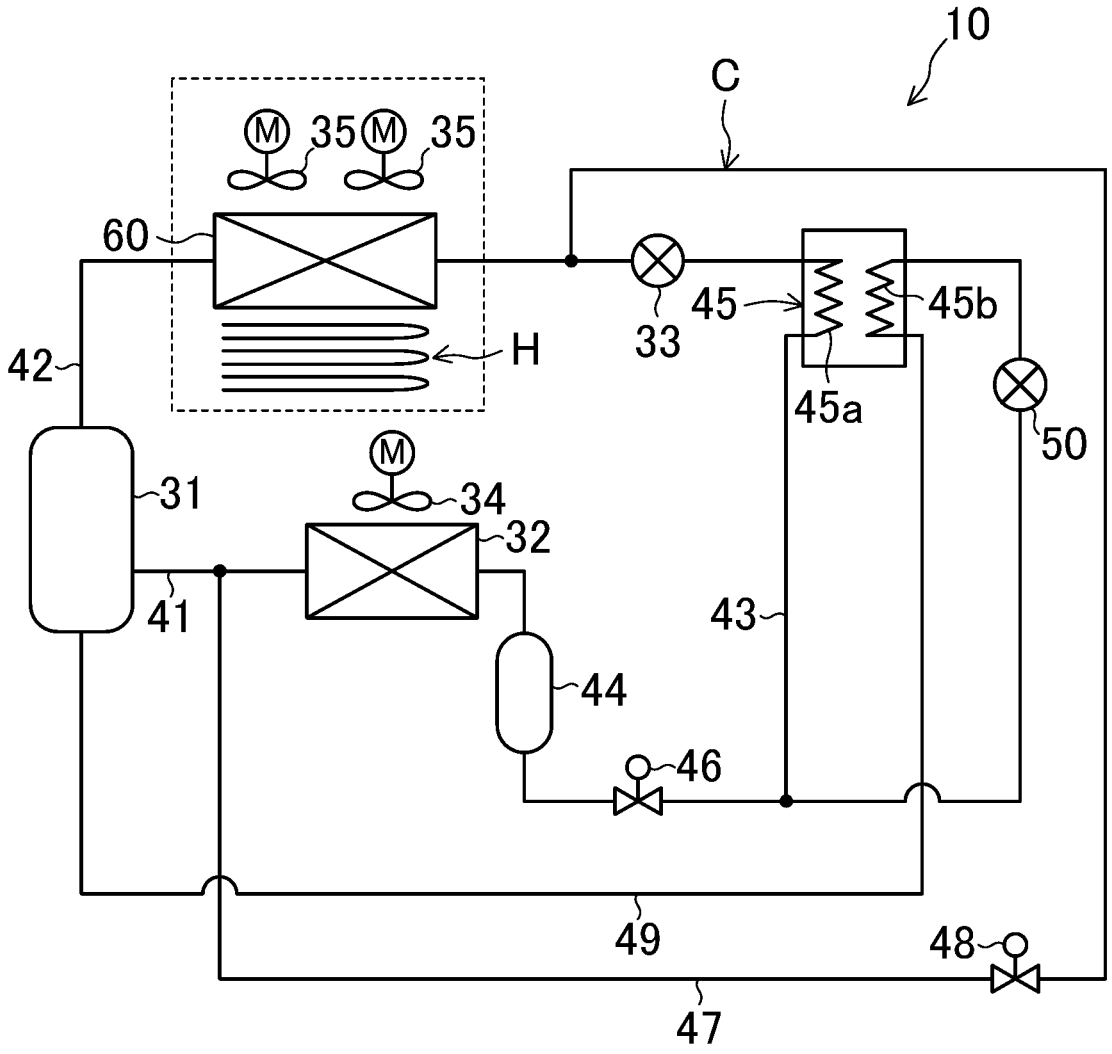
FIG. 3 is a piping system diagram of a refrigerant circuit of a refrigeration apparatus for transport according to the embodiment.

Details of the refrigerant circuit (C) will be described with reference to FIG. 3. In FIG. 3, components surrounded by a broken line square are internal ones, and the other components are external ones.

The refrigerant circuit (C) includes, as main components, the compressor (31), the external heat exchanger (32), the expansion valve (33), and the internal heat exchanger (60). The expansion valve (33) is an electronic expansion valve having a variable opening degree.

The refrigerant circuit (C) has a discharge pipe (41) and a suction pipe (42). One end of the discharge pipe (41) is connected to a discharge portion of the compressor (31). The other end of the discharge pipe (41) is connected to a gas end of the external heat exchanger (32). One end of the suction pipe (42) is connected to a suction portion of the compressor (31). The other end of the suction pipe (42) is connected to a gas end of the internal heat exchanger (60).

The refrigerant circuit (C) includes a liquid pipe (43), a receiver (44), a cooling heat exchanger (45), a first on-off valve (46), a connecting pipe (47), a second on-off valve (48), an injection pipe (49), and an injection valve (50).

One end of the liquid pipe (43) is connected to a liquid end of the external heat exchanger (32). The other end of the liquid pipe (43) is connected to a liquid end of the internal heat exchanger (60). The receiver (44) is provided for the liquid pipe (43). The receiver (44) is a container that stores the refrigerant.

The cooling heat exchanger (45) has a first flow path (45*a*) and a second flow path (45*b*). The cooling heat exchanger (45) exchanges heat between the refrigerant in the first flow path (45*a*) and the refrigerant in the second flow path (45*b*). The cooling heat exchanger (45) is, for example, a plate heat exchanger. The first flow path (45*a*) is a portion of the liquid pipe (43). The second flow path (45*b*) is a portion of the injection pipe (49). The cooling heat exchanger (45) cools the refrigerant flowing through the liquid pipe (43).

The first on-off valve (46) is arranged in the liquid pipe (43) to be located between the receiver (44) and the first flow path (45*a*). The first on-off valve (46) is an electromagnetic valve that can be opened and closed.

The connecting pipe (47) allows a high-pressure line and a low-pressure line of the refrigerant circuit (C) to communicate with each other. One end of the connecting pipe (47) is connected to the discharge pipe (41). The other end of the connecting pipe (47) is connected to the liquid pipe (43) to be located between the expansion valve (33) and the internal heat exchanger (60).

The second on-off valve (48) is provided for the connecting pipe (47). The second on-off valve (48) is an electromagnetic valve that can be opened and closed.

The injection pipe (49) introduces the refrigerant into an intermediate-pressure portion of the compressor (31). One end of the injection pipe (49) is connected to the liquid pipe (43) to be located between the receiver (44) and the first flow path (45*a*). The other end of the injection pipe (49) is connected to the intermediate-pressure portion of the compressor (31). The intermediate pressure, which is the pressure of the intermediate-pressure portion, is a pressure in a range between the suction pressure and the discharge pressure of the compressor (31).

The injection valve (50) is arranged upstream of the second flow path (45*b*) in the injection pipe (49). The injection valve (50) is an electronic expansion valve having a variable opening degree.

—Operation of Refrigeration Apparatus for Transport—

Basic operation of the refrigeration apparatus for transport (10) will be described below. When the refrigeration apparatus for transport (10) is in operation, the compressor (31), the external fan (34), and the internal fans (35) operate. The first on-off valve (46) opens. The second on-off valve (48) is closed. The opening degree of the expansion valve (33) is adjusted. The opening degree of the injection valve (50) is adjusted.

The refrigerant compressed by the compressor (31) flows through the external heat exchanger (32). The refrigerant in the external heat exchanger (32) dissipates heat to the outside air to condense. The condensed refrigerant passes through the receiver (44). Part of the refrigerant that has passed through the receiver (44) flows through the first flow path (45*a*) of the cooling heat exchanger (45). The remaining of the refrigerant that has passed through the receiver (44) flows through the injection pipe (49), and is decompressed to the intermediate pressure by the injection valve (50). The decompressed refrigerant is introduced into the intermediate-pressure portion of the compressor (31).

In the cooling heat exchanger (45), the refrigerant in the second flow path (45*b*) absorbs heat from the refrigerant in the first flow path (45*a*) to evaporate. This cools the refrigerant in the first flow path (45*a*). In other words, the degree of subcooling of the refrigerant flowing through the first flow path (45*a*) increases.

The refrigerant cooled in the cooling heat exchanger (45) is decompressed to a low pressure by the expansion valve (33). The decompressed refrigerant flows through the internal heat exchanger (60). The refrigerant in the internal heat exchanger (60) absorbs heat from the inside air to evaporate. Thus, the internal heat exchanger (60) cools the inside air. The evaporated refrigerant is sucked into the compressor (31) and compressed again.

The air in the container body (2) circulates between the storage space (5) and the internal flow path (20). The internal heat exchanger (60) cools the inside air in the internal flow path (20). Thus, the air in the storage space (5) can be cooled and adjusted to a predetermined temperature.

—Shape and Arrangement of External Heat Exchanger and Electric Component Box—

Figure 4:
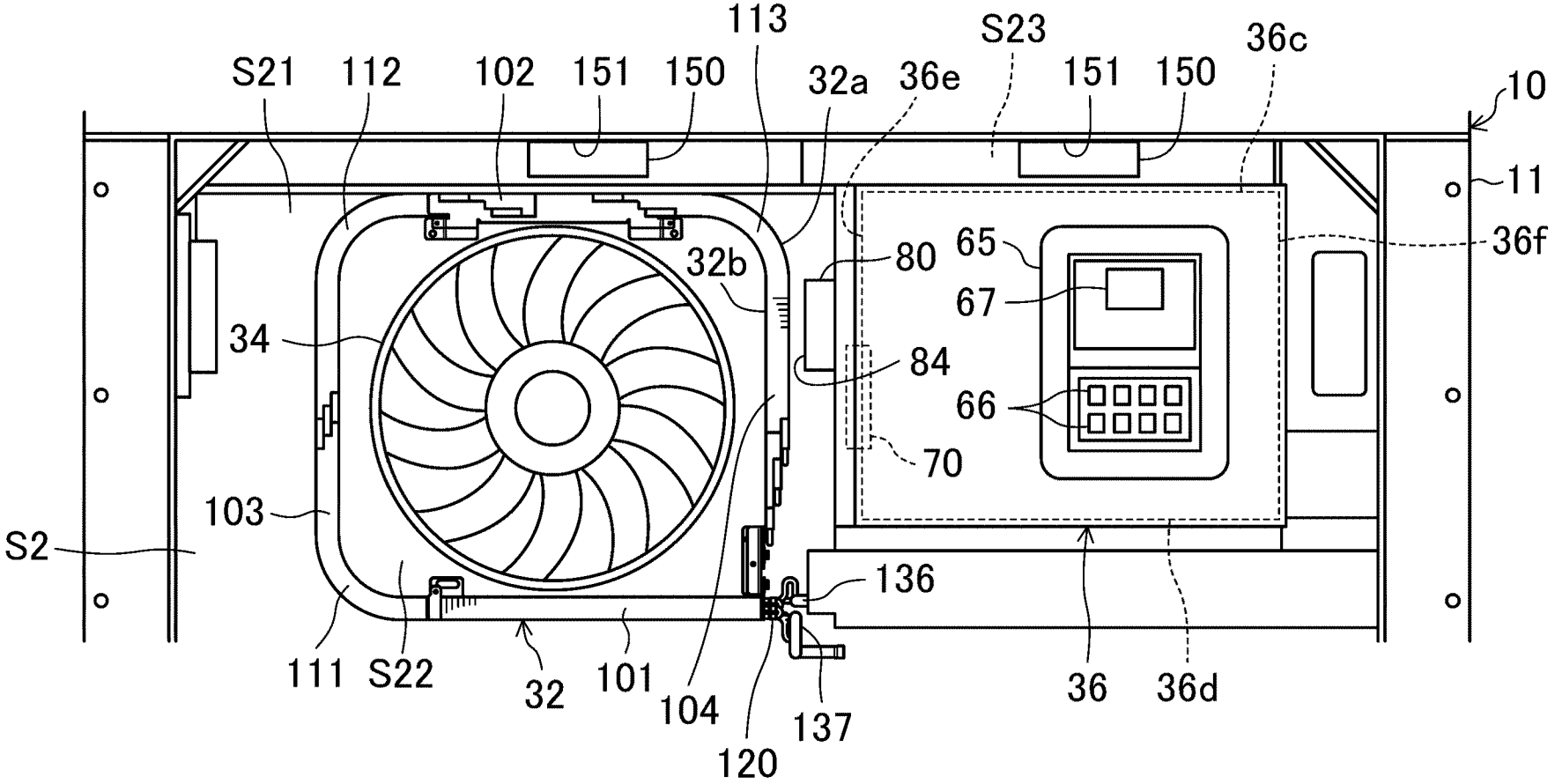
FIG. 4 is a front view illustrating a major part of the refrigeration apparatus for transport according to the embodiment, with a cover of an external heat exchanger removed.

As illustrated in FIG. 4, the external heat exchanger (32) and the electric component box (36) are provided in the second space (S2) of the external chamber (S). In the second space (S2), the external heat exchanger (32) is located closer to the left, and the electric component box (36) is located closer to the right. Thus, the electric component box (36) is located on the lateral side of the external heat exchanger (32).

<Shape and Arrangement of External Heat Exchanger>

The external heat exchanger (32) is formed in a rectangular tubular shape. The external heat exchanger (32) includes four flat portions (101 to 104) and three curved portions (111 to 113). Each flat portion (101 to 104) is a planar portion. Each curved portion (111 to 113) is curved in an arc shape of a quarter circle when viewed from the front.

A first flat portion (101) is the bottommost portion of the external heat exchanger (32) and generally extends in the horizontal direction. A first curved portion (111) is continuous with the left end of the first flat portion (101) and curves upward. A third flat portion (103) is continuous with the upper end of the first curved portion (111) and extends upward. A second curved portion (112) is continuous with the upper end of the third flat portion (103) and curves to the right. A second flat portion (102) is continuous with the right end of the second curved portion (112) and extends rightward. A third curved portion (113) is continuous with the right end of the second flat portion (102) and curves downward. A fourth flat portion (104) is continuous with the lower end of the third curved portion (113) and extends downward. In the external heat exchanger (32), the first flat portion (101) faces the second flat portion (102), and the third flat portion (103) faces the fourth flat portion (104).

The external heat exchanger (32) is fixed to the division wall (12) of the casing (11). The external heat exchanger (32) is attached to the casing (11) so that first flat portion (101) and the second flat portion (102) generally extend in the horizontal direction and the third flat portion (103) and the fourth flat portion (104) generally extend in the vertical direction.

The external heat exchanger (32) has a liquid side header (137) and a gas side header (136) at a right end portion of the first flat portion (101). The liquid side header (137) and the gas side header (136) are connected to a refrigerant pipe (120) of the external heat exchanger (32). In the external heat exchanger (32) that functions as a condenser or a radiator, the refrigerant flows into the refrigerant pipe (120) from the gas side header (136) and flows out of the refrigerant pipe (120) toward the liquid side header (137). The liquid side header (137) is a refrigerant outlet.

The external heat exchanger (32) has an outward surface serving as an air entrance surface (32*a*) and an inward surface serving as an air exit surface (32*b*). The air entrance surface (32*a*) and the air exit surface (32*b*) are imaginary surfaces formed by a plurality of arranged fins. The air flows through the external heat exchanger (32) from the air entrance surface (32*a*) toward the air exit surface (32*b*).

The second space (S2) of the external chamber (S) includes a primary space (S21) on the outside of the external heat exchanger (32) and a secondary space (S22) on the inside of the external heat exchanger (32). The primary space (S21) is a space upstream of the external heat exchanger (32). The secondary space (S22) is a space downstream of the external heat exchanger (32).

<Shape and Arrangement of Electric Component Box>

The electric component box (36) is a rectangular parallelepiped box. The electric component box (36) includes a front wall (36*a*), a rear wall (36*b*), a top wall (36*c*), a bottom wall (36*d*), a left wall (36*e*), and a right wall (36*f*).

An operation panel (65) is arranged on the front wall (36*a*). The operation panel (65) includes operation buttons (66) that an operator uses to input instructions for, e.g., on-off switching of the refrigeration apparatus for transport (10), and a display screen (67) that displays information such as an operating state of the refrigeration apparatus for transport (10).

The electric component box (36) is attached to the casing (11) with the front wall (36*a*) generally extending in the vertical direction. The electric component box (36) attached to the casing (11) has the left wall (36*e*) facing the fourth flat portion (104) of the external heat exchanger (32). The left wall (36*e*) of the electric component box (36) is an opposing plate that faces the air entrance surface (32*a*) of the external heat exchanger (32).

—Fork Pocket—

As illustrated in FIG. 4, the casing (11) has a pair of fork pockets (150). The fork pockets (150) are members that receive forks of a forklift or any other machine that lifts the refrigeration apparatus for transport (10). One of the fork pockets (150) is provided above the external heat exchanger (32) and the other above the electric component box (36).

Figure 5:
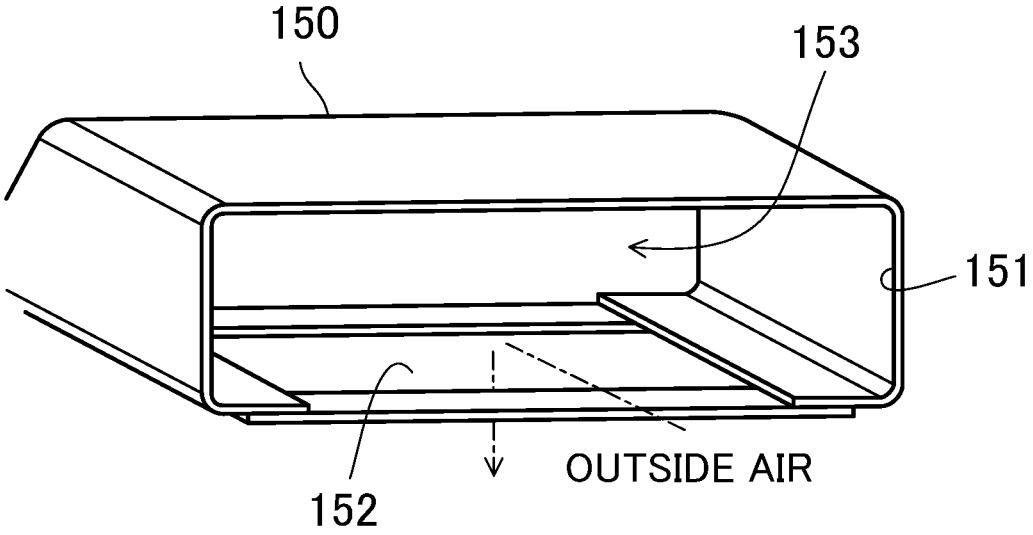
FIG. 5 is a schematic perspective view of fork pockets provided for the refrigeration apparatus for transport according to the embodiment.

As illustrated in FIG. 5, each fork pocket (150) has a tubular shape having a rectangular cross section. Both ends of the fork pocket (150) are open. One of the open ends of the fork pocket (150) is an insertion port (151). A connecting hole (152) is formed in a bottom wall portion of the fork pocket.

As illustrated in FIG. 4, each fork pocket (150) is attached to the casing (11) so that the long sides of the insertion port (151) generally extend in the horizontal direction and the insertion port (151) is exposed on the front side of the casing (11). An internal space (153) of the fork pocket (150) communicates with the primary space (S21) of the second space (S2) through the connecting hole (152). Specifically, the internal space (153) of the fork pocket (150) located above the top wall (36*c*) of the electric component box (36) communicates with the primary space (S21) through the connecting hole (152) and a portion of the second space (S2) above the electric component box (36).

—Detailed Configuration of Electric Component Box—

A detailed configuration of the electric component box (36) will be described with reference to FIGS. 6 to 8 as appropriate. As described above, the electric component box (36) houses the electric components, such as the inverter board (70), the control board (72), the relay board (73), and the reactors (74). The electric component box (36) also includes a heat sink (75), a duct (80), and a divider plate (90).

<Divider Plate>

The divider plate (90) is a member that divides the internal space of the electric component box (36) into left and right spaces. The internal space of the electric component box (36) is divided into a first room (37*a*) on the left of the divider plate (90) and a second room (37*b*) on the right of the divider plate (90) (see FIG. 6).

Figure 8:
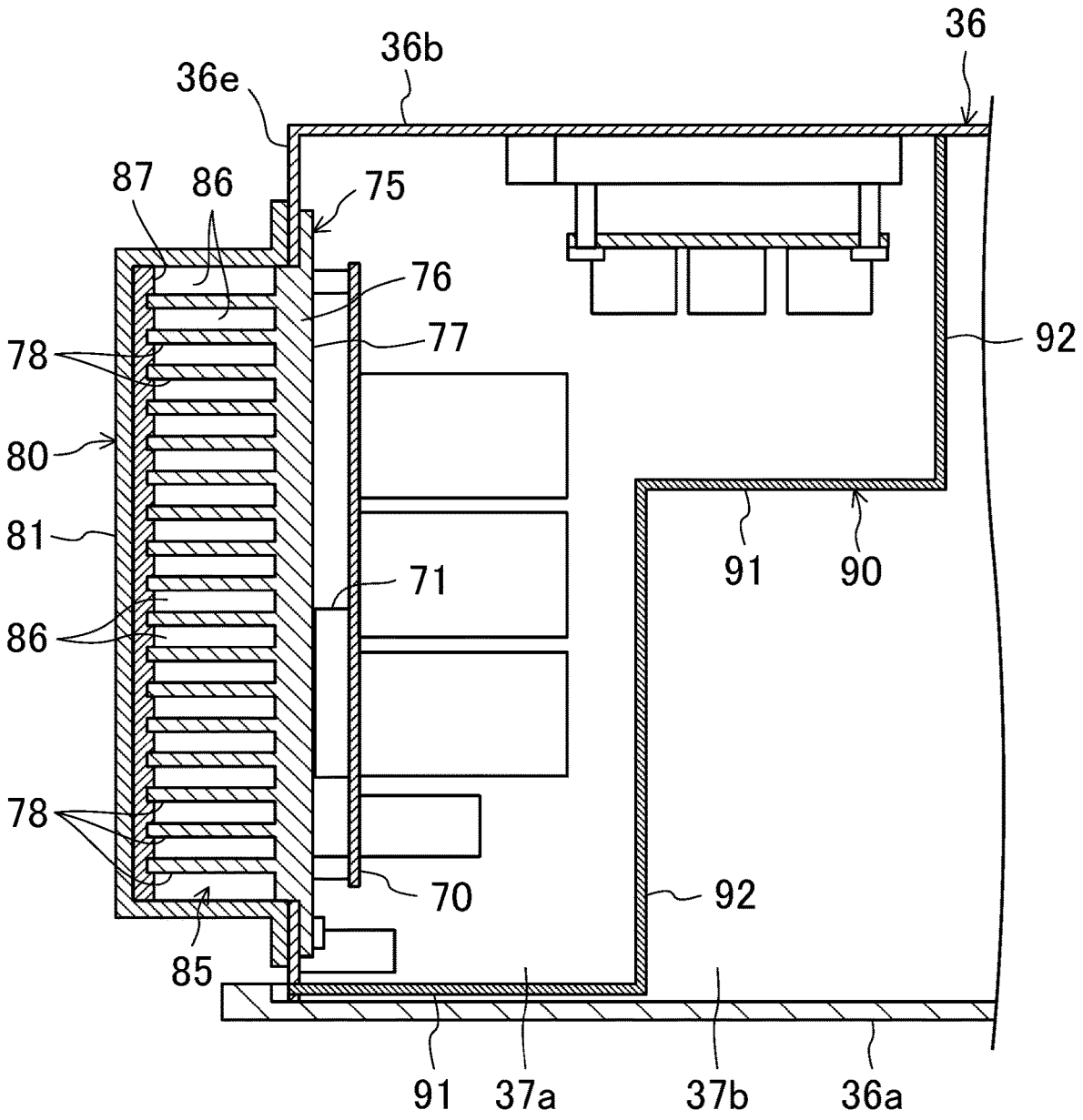
FIG. 8 is a cross-sectional view of a major part of the electric component box taken along the line VIII-VIII in FIG. 6.

The divider plate (90) is a plate-shaped member bent into a stair-like shape when viewed in plan (see FIG. 8). The height of the divider plate (90) is slightly smaller than the distance from the bottom wall (36*d*) to the top wall (36*c*) of the electric component box (36). The divider plate (90) is made of metal (e.g., copper and stainless steel). The divider plate (90) has the function of blocking noise (electromagnetic wave) generated by the inverter board (70).

Specifically, the divider plate (90) includes two forward-facing flat portions (91) and two laterally facing flat portions (92) (see FIG. 8). Each of the forward-facing flat portions (91) and the laterally facing flat portions (92) is formed into a rectangular plate shape. The forward-facing flat portions (91) and the laterally facing flat portions (92) are arranged with their long sides extending in the up-down direction. The forward-facing flat portions (91) and the laterally facing flat portions (92) of the divider plate (90) are alternately arranged. The forward-facing flat portion (91) and the laterally facing flat portion (92) adjacent to each other share one long side.

Figure 7:
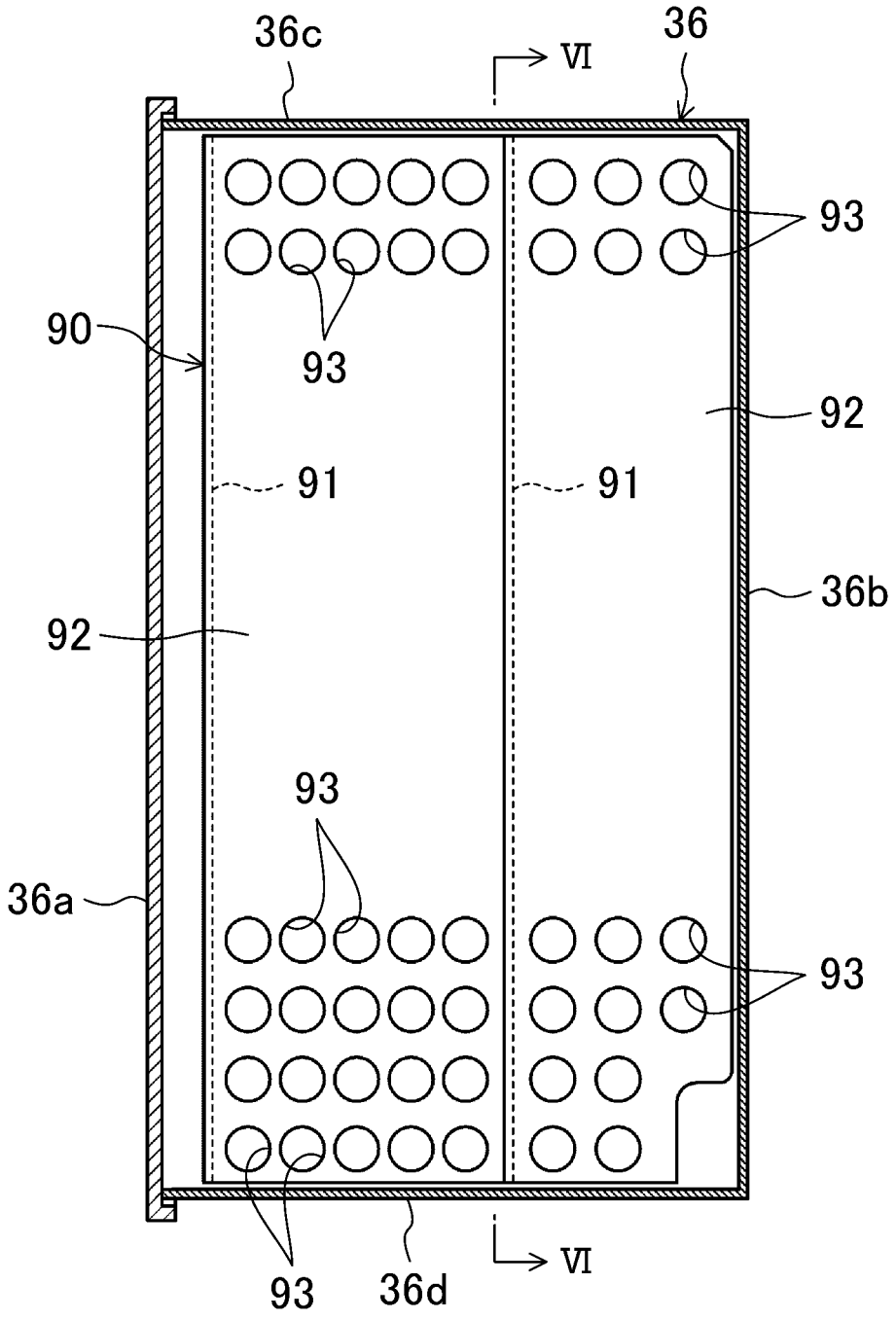
FIG. 7 is a cross-sectional view of the electric component box taken along the line VII-VII in FIG. 6.

As illustrated in FIG. 7, each of the laterally facing flat portions (92) of the divider plate (90) has a plurality of vent holes (93). The vent holes (93) are through holes penetrating the divider plate (90) in the thickness direction. The plurality of vent holes (93) are formed in an upper end region and a lower end region of each laterally facing flat portion (92). In each of the laterally facing flat portions (92), the number of vent holes (93) in the lower end region is greater than the number of the vent holes (93) in the upper end region. The vent holes (93) are formed only in the upper and lower end regions of each laterally facing flat portion (92). In other words, a middle portion in the up-down direction of each laterally facing flat portion (92) is a blocking portion having no vent holes (93).

<Heat Sink>

The heat sink (75) is a member for cooling a power module (71) of the inverter board (70).

Figure 6:
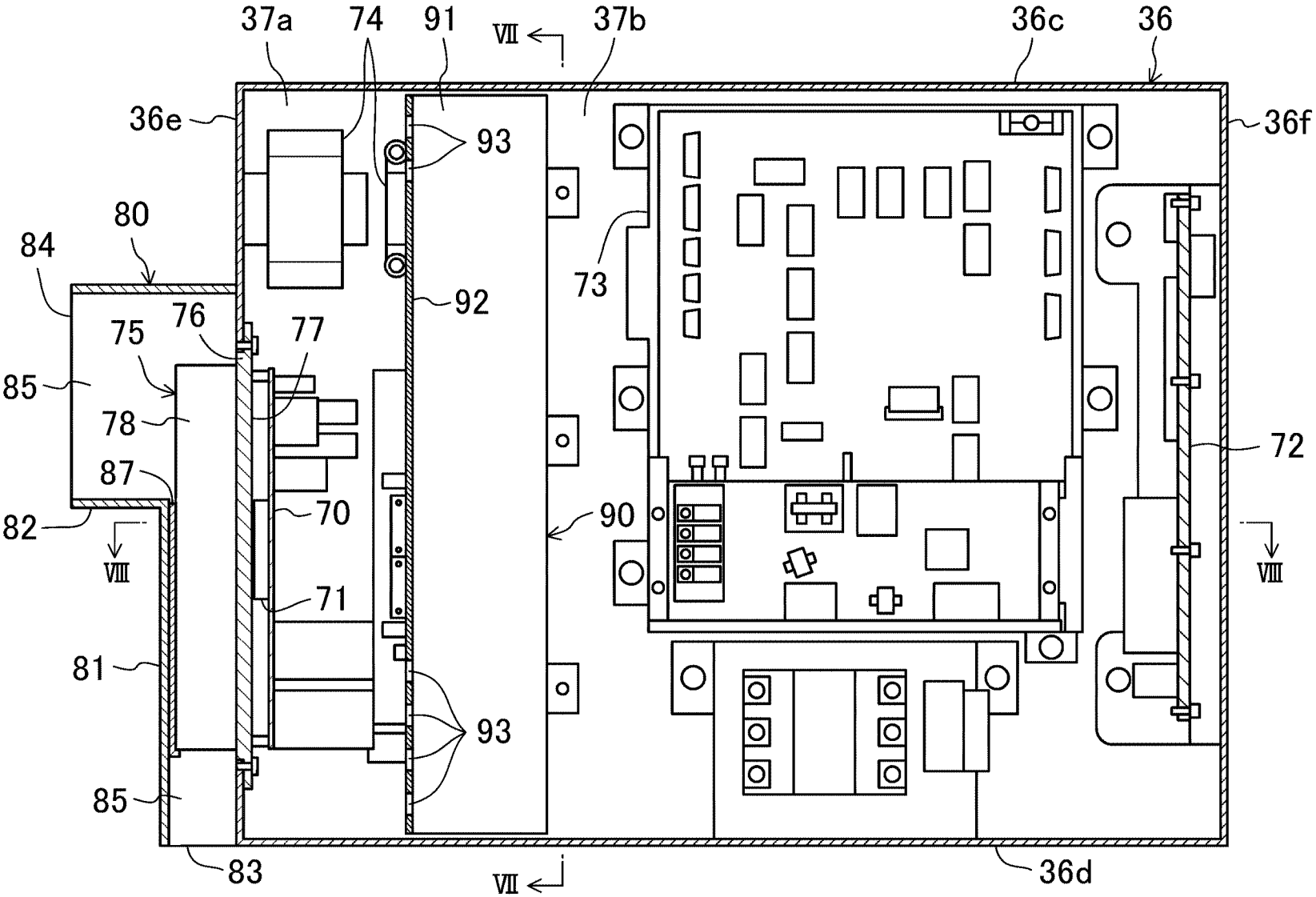
FIG. 6 is a cross-sectional view of an electric component box taken along the line VI-VI in FIG. 7.

As illustrated in FIGS. 6 and 8, the heat sink (75) includes a single base plate (76) and a plurality of fins (78). The base plate (76) and the fins are formed into a single piece. The heat sink (75) is made of metal (e.g., an aluminum alloy).

The base plate (76) is a rectangular plate-shaped portion. The base plate (76) is a substrate. Each fin (78) is formed in a rectangular plate shape. The fins (78) protrude from a front surface of the base plate (76). Each fin (78) has long sides parallel to the long sides of the base plate (76) and short sides generally orthogonal to the surface of the base plate (76). The plurality of fins (78) are arranged in the heat sink (75) at predetermined intervals in a direction of the short sides of the base plate (76). A rear surface of the base plate (76), i.e., a surface opposite to the fins (78), is a mounting surface (77) that makes contact with the power module (71).

The heat sink (75) is attached to the left wall (36*e*) of the electric component box (36). The heat sink (75) is provided on the left wall (36*e*) of the electric component box (36). The heat sink (75) is attached to the left wall (36*e*) with the long sides of the base plate (76) extending in the up-down direction. Specifically, the heat sink (75) is fitted in an opening formed in the left wall (36*e*) of the electric component box (36). The base plate (76) of the heat sink (75) covers the opening formed in the left wall (36*e*) from the inside of the electric component box (36). The fins (78) of the heat sink (75) protrude outward from the opening formed in the left wall (36*e*) and are exposed to the outside of the electric component box (36). When the heat sink (75) is attached to the electric component box (36), the long sides of the fins (78) extend in the up-down direction.

<Duct>

The duct (80) is a member for introducing the air to the fins (78) of the heat sink (75).

As illustrated in FIG. 6, the duct (80) is shaped in an inverted L-shaped cover. The duct (80) is attached to an outer surface of the left wall (36*e*) of the electric component box (36). The duct (80) is provided on the outer surface of the left wall (36*e*) of the electric component box (36). An air passage (85) is formed between the duct (80) and the left wall (36*e*). The duct (80) covers the fins (78) of the heat sink (75) exposed to the outside of the electric component box (36). Thus, the fins (78) of the heat sink (75) are housed in the air passage (85) formed by the duct (80).

The duct (80) has a first portion (81) extending in the up-down direction and a second portion (82) extending laterally from the first portion (81). The first portion (81) is formed in a channel shape extending in the up-down direction and covers the fins (78) of the heat sink (75). A lower end of the first portion (81) forms an air inlet (83) through which the air is introduced into the air passage (85). The second portion (82) is formed in a tubular shape extending laterally from an upper end of the first portion (81) (to the left in FIG. 6). An open end located at the protruding end of the second portion (82) forms an air outlet (84) from which the air is discharged out of the air passage (85). As illustrated in FIG. 4, the air outlet (84) faces the air entrance surface (32*a*) of the fourth flat portion (104) of the external heat exchanger (32).

As illustrated in FIG. 8, a sheet-shaped seal (87) is adhered to an inner surface of the first portion (81) of the duct (80). The seal (87) is made of, for example, a soft resin foam. The seal (87) makes contact with the protruding ends of the fins (78) of the heat sink (75) to fill the gap between the protruding ends of the fins (78) and the inner surface of the first portion (81). The air passage (85) in the duct (80) is divided into a plurality of flow paths (86) by the fins (78) having the protruding ends in contact with the seal (87). Each of the plurality of flow paths (86) is surrounded by an adjacent pair of fins (78), the base plate (76), and the seal (87).

<Electric Components>

As illustrated in FIGS. 6 and 8, the electric component box (36) houses the electric components, such as the inverter board (70), the control board (72), the relay board (73), and the reactors (74). The inverter board (70) and the reactors (74) are located in the first room (37*a*). The control board (72) and relay board (73) are located in the second room (37*b*).

The inverter board (70) is equipped with the power module (71) that is a heat-producing component. The power module (71) supplies alternating current to an electric motor of the compressor (31). When the output frequency of the power module (71) changes, the rotational speed of the compressor (31) changes, and the refrigerating capacity obtained as a result of the refrigeration cycle by the refrigerant circuit (C) changes.

The inverter board (70) is arranged to face the mounting surface (77) of the base plate (76) of the heat sink (75). The power module (71) of the inverter board (70) is thermally connected to the base plate (76) of the heat sink (75). In this embodiment, the power module (71) makes contact with the mounting surface (77) of the base plate (76) of the heat sink (75). Heat produced by the power module (71) is conducted to the heat sink (75).

In the electric component box (36), two reactors (74) are attached to the left wall (36*e*) and one reactor (74) is attached to the rear wall (36*b*). The three reactors (74) are located above the inverter board (70). The three reactors (74) are located on the lateral side of the vent holes (93) formed in the upper end region of the divider plate (90).

The control board (72) is attached to the right wall of the electric component box (36). The control board (72) is located farthest from the inverter board (70). The relay board (73) is attached to the rear wall of the electric component box (36).

—Flow of Cooling Air—

The flow of the air that cools the inverter board (70) will be described below.

When the external fan (34) operates, the outside air flows into the primary space (S21) of the second space (S2), and flows toward the external heat exchanger (32). Part of the outside air that has flowed into the primary space (S21) flows into the air passage (85) in the duct (80).

The air that has flowed into the air passage (85) through the air inlet (83) of the duct (80) enters the plurality of flow paths (86) divided by the fins (78) of the heat sink (75), and goes upward through the flow paths (86). The air absorbs heat from the heat sink (75) as passing through the flow paths (86). Heat that has been conducted from the power module (71) to the heat sink (75) is dissipated to the air flowing through the air passage (85). This keeps the temperature of the power module (71) from rising excessively.

The air that has absorbed heat from the heat sink (75) flows out of the air passage (85) through the air outlet (84). The air outlet (84) of the duct (80) faces the fourth flat portion (104) of the external heat exchanger (32). Thus, the air that has absorbed heat from the heat sink (75) flows from the air outlet (84) toward the fourth flat portion (104) of the external heat exchanger (32), and passes through the fourth flat portion (104) from the air entrance surface (32*a*) toward the air exit surface (32*b*).

—Flow of Air in Electric Component Box—

The flow of air in the electric component box (36) will be described below.

The electric component box (36) houses the inverter board (70) and the reactors (74) having temperatures that relatively increase during operation in the first room (37*a*), and houses the control board (72) and the relay board (73) having temperatures that do not greatly increase during operation in the second room (37*b*). Thus, while the refrigeration apparatus for transport (10) is in operation, the first room (37*a*) is usually hotter than the second room (37*b*).

The laterally facing flat portions (92) of the divider plate (90) have the vent holes (93) formed only in the upper and lower end regions. Thus, the flow of air that circulates between the first room (37*a*) and the second room (37*b*) occurs in the electric component box (36).

Specifically, the air in the first room (37*a*) is heated by the inverter board (70) and the reactors (74). The heated air in the first room (37*a*) flows upward and enters the second room (37*b*) through the vent holes (93) formed near the upper end of the divider plate (90). The temperature of air in the second room (37*b*) is cooler than the temperature of air in the first room (37*a*). Thus, when the upward air flow is generated in the first room (37*a*), the air in the second room (37*b*) flows into the first room (37*a*) through the vent holes (93) formed near the lower end of the divider plate (90). This keeps the temperature of the first room (37*a*) from rising excessively.

In the first room (37*a*), the reactors (74) are provided above the inverter board (70). The temperature of the inverter board (70) in operation and the temperature of the reactors (74) in operation are both around 60° C. to 70° C. The operating reactors (74) have a slightly higher temperature than the operating inverter board (70).

Thus, in the first room (37*a*), the reactors (74), which are hotter than the inverter board (70), are located above the inverter board (70). As mentioned above, the upward air flow is generated in the first room (37*a*). Thus, the heat generated by the reactors (74) is less likely to be transferred to the inverter board (70), keeping the temperature of the inverter board (70) from increasing.

Feature (1) of Embodiment

The refrigeration apparatus for transport (10) of this embodiment includes the electric component box (36) arranged on the lateral side of the external heat exchanger (32). The electric component box (36) houses the inverter board (70). The left wall (36*e*) of the electric component box (36) faces the air entrance surface (32*a*) of the external heat exchanger (32). The heat sink (75) is provided on the left wall (36*e*) of the electric component box (36). The heat sink (75) receives and dissipates heat produced by the power module (71) on the inverter board (70).

In this embodiment, when the electric component box (36) that houses the inverter board (70) is arranged on the lateral side of the external heat exchanger (32), the heat produced by the power module (71) of the inverter board (70) can be dissipated to the air. This can keep the temperature of the power module (71) from increasing excessively. Thus, this embodiment can provide a heat dissipation structure of the refrigeration apparatus for transport (10) in which the electric component box (36) that houses the inverter board (70) is arranged on the lateral side of the external heat exchanger (32).

Feature (2) of Embodiment

The refrigeration apparatus for transport (10) of this embodiment includes the duct (80). The duct (80) forms the air passage (85) in which the heat sink (75) is arranged. The heat conducted from the power module (71) on the inverter board (70) to the heat sink (75) is dissipated to the air flowing through the air passage (85) formed by the duct (80).

Feature (3) of Embodiment

The duct (80) of the refrigeration apparatus for transport (10) of this embodiment has the air inlet (83) opening downward. This keeps rainwater and sea water from entering the air passage (85) in the duct (80) through the air inlet (83). This can reduce corrosion of the heat sink (75) in the air passage (85), maintaining the reliability of the refrigeration apparatus for transport (10).

Feature (4) of Embodiment

The duct (80) of the refrigeration apparatus for transport (10) of this embodiment has the air outlet (84) opening toward the air entrance surface (32*a*) of the external heat exchanger (32). Thus, the air that has absorbed heat from the heat sink (75) while passing through the air passage (85) in the duct (80) flows from the air outlet (84) toward the air entrance surface (32*a*) of the external heat exchanger (32).

Feature (5) of Embodiment

The duct (80) of the refrigeration apparatus for transport (10) of this embodiment has the first portion (81) and the second portion (82). The first portion (81) has the air inlet (83) and extends in the up-down direction. The second portion (82) is continuous with the first portion (81), extends laterally from the first portion (81), and has an air outlet (84). The air that has flowed into the air passage (85) through the air inlet (83) passes the first portion (81) and the second portion (82) of the duct (80) in order, and flows out of the air passage (85) through the air outlet (84).

Specifically, in the duct (80) of this embodiment, the air inlet (83) is formed at the lower end of the first portion (81) and the air outlet (84) is formed at the protruding end of the second portion (82) extending laterally from the first portion (81). Thus, this embodiment keeps rainwater and sea water from entering the air passage (85) in the duct (80). This can reduce corrosion of the heat sink (75) in the air passage (85), maintaining the reliability of the refrigeration apparatus for transport (10).

Further, in the duct (80) of this embodiment, the air outlet (84) at the protruding end of the second portion (82) faces the external heat exchanger (32). Thus, the air flowed from the air outlet (84) goes toward the external heat exchanger (32), causing the air in the air passage (85) in the duct (80) to reliably flow from the air inlet (83) toward the air outlet (84). This can maintain the amount of heat that the heat sink (75) dissipates to the air, keeping the temperature of the power module (71) in a proper range.

Feature (6) of Embodiment

The heat sink (75) of the refrigeration apparatus for transport (10) of this embodiment includes the single base plate (76) and the plurality of fins (78). The plate-shaped base plate (76) has the mounting surface (77) that makes contact with the power module (71). The plate-shaped fins (78) protrude from the surface of the base plate (76) different from the mounting surface (77).

In the refrigeration apparatus for transport (10) of this embodiment, the air passage (85) formed by the duct (80) is divided into the plurality of flow paths (86) by the fins (78). The air that has flowed into the air passage (85) passes through the plurality of flow paths (86) and makes contact with the fins (78). Thus, in this embodiment, the air is reliably brought into contact with the fins (78). This can maintain the amount of heat that the heat sink (75) dissipates to the air, keeping the temperature of the power module (71) in a proper range.

Feature (7) of Embodiment

In the refrigeration apparatus for transport (10) of this embodiment, the fins (78) of the heat sink (75) extend in the up-down direction. Thus, even if water enters the air passage (85), the water will not stay on the fins (78). This embodiment can reduce corrosion of the heat sink (75), maintaining the reliability of the refrigeration apparatus for transport (10).

Feature (8) of Embodiment

In the refrigeration apparatus for transport (10) of this embodiment, the control board (72) is housed in the electric component box (36). The control board (72) controls the components of the refrigeration apparatus for transport (10).

Feature (9) of Embodiment

In the refrigeration apparatus for transport (10) of this embodiment, the internal space of the electric component box (36) is divided into the first room (37*a*) and the second room (37*b*) by the divider plate (90). The first room (37*a*) houses the inverter board (70). The second room (37*b*)

houses the control board (72). The divider plate (90) made of metal reduces noise propagation from the inverter board (70) to the control board (72). Thus, according to this embodiment, the inverter board (70) and the control board (72) can be housed in the single electric component box (36), with the control board (72) kept operating properly.

Feature (10) of Embodiment

In the refrigeration apparatus for transport (10) of this embodiment, the vent holes (93) are formed in the upper and lower portions of the divider plate (90) of the electric component box (36). Thus, as mentioned above, the flow of air that circulates between the first room (37*a*) and the second room (37*b*) occurs in the internal space of the electric component box (36). This keeps the temperature of the first room (37*a*) from rising excessively, keeping the temperature of the inverter board (70) in a proper range.

Feature (11) of Embodiment

In the refrigeration apparatus for transport (10) of this embodiment, the reactors (74) are housed in the electric component box (36). The reactors (74) are located above the inverter board (70). This can reduce the heat to be transferred from the reactors (74) to the inverter board (70), keeping the temperature of the inverter board (70) from increasing.

Feature (12) of Embodiment

The external heat exchanger (32) of the refrigeration apparatus for transport (10) of this embodiment has the liquid side header (137) serving as a refrigerant outlet at one end thereof. The air that has passed through the heat sink (75) passes near the other end of the external heat exchanger (32).

The air that has absorbed heat from the heat sink (75) of this embodiment flows through a portion of the external heat exchanger (32) away from the liquid side header (137) serving as the refrigerant outlet. Thus, in this embodiment, even when the air that has absorbed heat from the heat sink (75) passes through the external heat exchanger (32), the temperature of the refrigerant flowing out of the external heat exchanger (32) can be kept low.

Feature (13) of Embodiment

The refrigeration apparatus for transport (10) of this embodiment has the fork pockets (150) provided above the electric component box (36). The fork pockets (150) receive forks that lift the refrigeration apparatus for transport (10). The space (S23) between the electric component box (36) and each fork pocket (150) communicates with the "internal space (153) of each fork pocket (150)" and the "primary space (S21) of the second space (S2)."

In the refrigeration apparatus for transport (10) of this embodiment, the air that has passed through the fork pockets (150) flows toward the external heat exchanger (32). Thus, the flow rate of the air going toward the external heat exchanger (32) can be easily maintained.

First Variation of Embodiment

The transport container (1) of this embodiment may be used for land transportation. In this case, the transport container (1) is conveyed by a land transporter, such as a vehicle. Specifically, the transport container (1) is mounted on a trailer.

Second Variation of Embodiment

The divider plate (90) provided in the electric component box (36) of the refrigeration apparatus for transport (10) of this embodiment may have the vent holes (93) only in the forward-facing flat portions (91), or in both of the forward-facing flat portions (91) and the laterally facing flat portions (92).

While the embodiments and variations thereof have been described above, it will be understood that various changes in form and details may be made without departing from the spirit and scope of the claims. The embodiments, the variations, and the other embodiments may be combined and replaced with each other without deteriorating intended functions of the present disclosure. The ordinal numbers such as "first," "second," "third," . . . , described above are used to distinguish the terms to which these expressions are given, and do not limit the number and order of the terms.

INDUSTRIAL APPLICABILITY

As can be seen from the foregoing description, the present disclosure is useful for a refrigeration apparatus for transport and a transport container.

EXPLANATION OF REFERENCES

1 Transport Container
10 Refrigeration Apparatus for Transport
32 External Heat Exchanger (Condenser)
32*a* Air Entrance Surface
36 Electric Component Box (Box)
37*a* First Room (Space)
37*b* Second Room (Space)
36*e* Opposing Plate
70 Inverter Board
71 Power Module (Heat-Producing Component)
72 Control Board
74 Reactor
75 Heat Sink
76 Base Plate (Substrate)
77 Mounting Surface
78 Fin
81 Duct
81 First Portion
82 Second Portion
83 Air Inlet
84 Air Outlet
85 Air Passage
86 Flow Path
90 Divider Plate
93 Through Hole
137 Liquid Side Header (Refrigerant Outlet)
150 Fork Pocket
S21 Primary Space
S23 Space

The invention claimed is:

1. A refrigeration apparatus for transport, comprising:

a condenser having an air entrance surface and an air exit surface, the condenser being configured to allow air to flow from the air entrance surface toward the air exit surface; and a box arranged on a lateral side of the condenser and houses an inverter board, wherein the box has an opposing plate that faces the air entrance surface of the condenser, and the refrigeration apparatus for transport includes a heat sink that is provided on the opposing plate and exposed to an outside of the box to cool a heat-producing component on the inverter board.

2. The refrigeration apparatus for transport of claim 1, further comprising:

a duct that forms an air passage in which the heat sink is arranged.

3. The refrigeration apparatus for transport of claim 2, wherein the duct has an air inlet opening downward.

4. The refrigeration apparatus for transport of claim 3, wherein the duct has an air outlet opening toward the air entrance surface of the condenser.

5. The refrigeration apparatus for transport of claim 4, wherein the duct has a first portion having an air inlet and extending in a predetermined direction, and a second portion having an air outlet, the second portion being continuous with the first portion and extending in a direction intersecting with the predetermined direction.

6. The refrigeration apparatus for transport of claim 3, wherein the duct has a first portion having an air inlet and extending in a predetermined direction, and a second portion having an air outlet, the second portion being continuous with the first portion and extending in a direction intersecting with the predetermined direction.

7. The refrigeration apparatus for transport of claim 3, wherein the condenser has a refrigerant outlet at one end, and air that has passed through the heat sink passes near the other end of the condenser.

8. The refrigeration apparatus for transport of claim 2, wherein the duct has an air outlet opening toward the air entrance surface of the condenser.

9. The refrigeration apparatus for transport of claim 8, wherein the duct has a first portion having an air inlet and extending in a predetermined direction, and a second portion having an air outlet, the second portion being continuous with the first portion and extending in a direction intersecting with the predetermined direction.

10. The refrigeration apparatus for transport of claim 2, wherein the duct has a first portion having an air inlet and extending in a predetermined direction, and a second portion having an air outlet, the second portion being continuous with the first portion and extending in a direction intersecting with the predetermined direction.

11. The refrigeration apparatus for transport of claim 2, wherein the heat sink includes: a plate-shaped substrate having a mounting surface that makes contact with the heat-producing component; and a plurality of plate-shaped fins protruding from a surface of the substrate different from the mounting surface, and the fins divide the air passage formed by the duct into a plurality of flow paths.

12. The refrigeration apparatus for transport of claim 11, wherein the fins of the heat sink extend in an up-down direction.

13. The refrigeration apparatus for transport of claim 2, wherein the condenser has a refrigerant outlet at one end, and air that has passed through the heat sink passes near the other end of the condenser.

14. The refrigeration apparatus for transport of claim 1, further comprising:

a control board that is housed in the box and controls the refrigeration apparatus for transport.

15. The refrigeration apparatus for transport of claim 1, further comprising:

a reactor housed in the box and arranged above the inverter board.

16. The refrigeration apparatus for transport of claim 1, wherein the condenser has a refrigerant outlet at one end, and air that has passed through the heat sink passes near the other end of the condenser.

17. A transport container, comprising: the refrigeration apparatus for transport of claim 1; and a container body.

18. A refrigeration apparatus for transport, comprising:

a condenser having an air entrance surface and an air exit surface, the condenser being configured to allow air to flow from the air entrance surface toward the air exit surface;

a box arranged on a lateral side of the condenser and houses an inverter board;

a control board that is housed in the box and controls the refrigeration apparatus for transport;

a divider plate provided in the box to separate a space housing the inverter board and a space housing the control board from each other and reduce noise propagation from the inverter board to the control board, wherein the box has an opposing plate that faces the air entrance surface of the condenser, and the refrigeration apparatus for transport includes a heat sink that is provided on the opposing plate and exposed to an outside of the box to cool a heat-producing component on the inverter board.

19. The refrigeration apparatus for transport of claim 18, wherein through holes are formed in upper and lower portions of the divider plate.

* * * * *